US006314880B1

(12) United States Patent
Lampinski

(10) Patent No.: US 6,314,880 B1
(45) Date of Patent: Nov. 13, 2001

(54) METHOD FOR ETCHING PAD PRINTING CLICHÉ AND PAD-PRINTING ON A GOLF BALL

(75) Inventor: Daniel B. Lampinski, Pawtucket, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/531,752

(22) Filed: Mar. 20, 2000

(51) Int. Cl.[7] ..... B41M 1/10; B41M 17/30

(52) U.S. Cl. ..... 101/170; 101/163; 101/35; 101/41; 101/401.1; 101/DIG. 40; 430/307

(58) Field of Search ..... 101/35, 41, 150, 101/163, 170, 401, 401.1, 395, DIG. 40, 492, 493; 430/306, 307, 309, 310

(56) References Cited

U.S. PATENT DOCUMENTS

| | | | |
|---|---|---|---|
| 4,745,857 | 5/1988 | Putnam et al. | 101/44 |
| 4,803,922 | 2/1989 | Dennesen | 101/41 |
| 4,896,598 | 1/1990 | Leech, Jr. | 101/170 |
| 5,237,922 | 8/1993 | Ho | 101/333 |
| 5,513,567 | 5/1996 | Froh et al. | 101/170 |
| 5,778,793 | 7/1998 | Mello et al. | 101/494 |
| 6,007,967 * | 12/1999 | Kumpfmiller et al. | 430/306 |

* cited by examiner

*Primary Examiner*—Leslie J. Grohusky
(74) *Attorney, Agent, or Firm*—Pennie & Edmonds LLP

(57) ABSTRACT

A method for etching a pad-printing cliché and printing an image therefrom on a golf ball comprising providing a film positive of an image; placing the film positive on a pad-printing cliché having a variable relief photocurable pre-polymer surface; curing the pre-polymer that is not blocked by the film positive; removing the film positive from the polymer surface; washing the pad-printing cliché for a first predetermined time sufficient to remove any uncured pre-polymer, such that the pad-printing cliché has the image etched into the pre-polymer surface, the etched image having a substantially homogeneous bottom surface that is free of protrusions formed by screens, normally required for variable relief material, heating the pre-polymer for a second predetermined time sufficient to fully dry the pre-polymer; further curing the pre-polymer exposed by the washing step; providing a golf ball having a dimpled surface; distributing a layer of ink over the etched image in the pad-printing cliché; providing a pad for transferring the ink from the pad-printing cliché to the dimpled surface; and transferring the image from the surface of the pad-printing cliché to the dimpled surface of the golf ball.

18 Claims, 2 Drawing Sheets

METHOD FOR ETCHING PAD PRINTING CLICHÉ AND PAD-PRINTING ON A GOLF BALL

FIELD OF THE INVENTION

This invention relates to a method for etching a pad-printing cliché and printing an image therefrom on golf balls.

BACKGROUND OF THE INVENTION

More than five hundred million golf balls are produced each year, of which, a significant percentage have some type of decorative logo printed on their outer surface. For example, many logos advertise or identify a particular corporate entity, golf course, country club, or resort.

Currently, two different approaches are commonly used to add decorative logos to the dimpled surface of golf balls. One approach is to first create a decal of the logo, apply the decal to the spherical, dimpled golf ball surface, and then spray the golf ball cover with a clear finish. This decal process is limited in several different ways. First, decals are generally purchased by the golf ball manufacturer from a vendor or secondary printing source. Defective or off-color decals must be returned to the vendor, potentially causing delays in providing customers with orders within a competitive time frame. Furthermore, decals are expensive and the material and labor costs for adding decals to the dimpled surface of a golf ball averages four to seven times what it would cost to pad-print logos onto a golf ball. Additionally, the variety of colors and/or shading of those colors can be limited by the manufacturing and printing process of decals. Decals are typically made using a silk screening process which, by its nature, limits the number of colors and inhibits the use of shading.

The second approach to adding a logo to the dimpled surface of a golf ball is pad printing. Pad printing is an indirect intaglio process. Depressions representing the logo of choice are created on a flat surface called "the plate" or pad printing cliché. There are two types of plates—variable depth relief photopolymer plates and fixed depth relief plates. The depressions for logos having multiple colors require multiple plates that are dedicated to each individual color of the image to be printed. A plate for each color in the image is etched, by way of a photoactive polymer and a film positive, by UV light. In the case of variable depth relief photopolymer plates, after an initial exposure period, the logo and plate are completely covered with a screen film and exposed to UV light again ("screening"); this step is not necessary for fixed depth relief plates. Screening is a process that places many small "dots," in the shape of truncated cones, into the surface of the etched image itself.

The screen film can have frames of about 50 to 1,000 lines per inch or, more preferably, from about 100 to 300 lines per inch. For example, if the screen film has 80 lines/cm, there will be 64 small circular surfaces per $mm^2$, each with a diameter of 0.02 to 0.03 mm. This also explains why only high-quality, fine grained material can be used for making the plates. The quality and sharpness of the printed image are still maintained, as the screen spots show only very slightly at the edges.

The pad printing process begins by spreading ink across the surface of the plate with a spatula. Excess ink is then scraped back into an ink reservoir using a "doctor blade" which leaves ink only in the depressions on the plate. As the plate is exposed to air, thinner evaporates from the remaining ink in the depressions causing the ink surface to become tacky. A smooth, resilient, stamp block of silicone rubber is used to lift ink from the plate and transfer it to the golf ball surface. The stamp block is termed a "pad" and it is this term that has lent its name to the printing process. As the pad is lowered over the depressions in the surface of the plate, the tacky ink sticks to the pad. As the pad lifts, it takes with it not only the tacky, adhering film of ink, but also some excess fluid ink underneath. This film of ink is carried on the pad to the target area on the dimpled golf ball surface. The time that elapses during this transfer process allows thinner to evaporate from the exposed surface of the ink on the silicone pad, and the ink surface facing away from the pad becomes tacky. As the pad is applied to the golf ball surface, the tacky film of ink adheres to the ball surface and separates from the pad as it is lifted from the surface.

The pad printing process of adding logos to golf balls, which is used as an alternative to the decal method, requires less time and is less expensive than the decal method. Pad printing is not without problems, though. Printing certain types of images sometimes results in non-uniform color, a print quality problem known to those skilled in the art as "shading." Additionally, some images exhibit non-uniform screening. This problem typically results from variations in depth of etch between the plurality of truncated cones within each etched area on the plates. Further, certain colors are difficult to color-match, especially with the truncated cones present in the etch which further "dilute" the vibrancy of the color. It is clear that most of the current problems arise from the etching of the plates and ink transfer therefrom.

There are two basic types of photopolymer plate materials available—alcohol wash and water wash plates. Water wash plates are the preferred plate because of obvious environmental and safety issues. Within these two categories there are two styles of plates—fixed depth and variable depth plates. Fixed depth plates are just that—the depth of etch cannot be varied. Along the same lines, variable depth plates allow the depth of etch to be optimized for a particular application. The standard depth of etch for fixed depth steel plates is typically 0.001 in (25.4 $\mu$m). Fixed depth plastic plates, of which there are precious few (there are only two commercially available fixed depth plates, the T-30 alcohol wash plate and the WT-30 water wash plate, both from BASF), are manufactured to the same standard, having a relief layer of 0.001 in. The more common variable depth plastic plates, such as the WSA-52, commercially available from BASF, are manufactured with much thicker photosensitive relief layers that allow a large variation in depth of etch to be obtained. While a 0.001-in depth of etch is the standard for most pad printing applications, it is too deep to be used successfully with the present invention. Additionally, one of ordinary skill in the art is aware that with the water wash, a fixed depth plate lacks the hardness to be used successfully with many current pad printing methods, such as a scaled ink CLIP system.

The processing procedures, as specified by all plate suppliers/manufacturers, for variable relief plates call for the use of a screen tint (creating the truncated cones discussed above) to control the depth of etch and, therefore, the amount of ink picked up by the pad and transferred to the product, in this case a golf ball. A secondary and important benefit of the screen exposure step is to create a support structure in the etch to prevent the doctor blade from scooping ink as it passes over larger (open) areas of the graphic design. As discussed above, the screen exposure step results in a uniform pattern of truncated cones formed in the etch that, when done properly, results in a similar capacity for ink transfer as a standard open etch steel plate. The advantages are thus numerous: the doctor blade is supported by the small truncated cones, preventing it from dropping into the open areas and remove too much ink in a non-uniform manner; the truncated cones created by the screening step hold back the ink evenly; additionally, the pad is further supported by the small truncated cones and can not squeeze out the ink as it touches the surface. All of these advantages result in homogeneous Ink pick resulting in a quality imprint.

Therefore, one of ordinary skill in the art would not normally attempt to process a variable depth plastic plate without the screen. It is considered very difficult to control the depth of etch (and subsequently the ink transfer) without the screen step. One or ordinary skill in the art, in an attempt to control this, would normally or logically attempt to qualify a commercially available fixed depth plastic plate rather than attempt the unorthodox steps proposed by the present invention.

U.S. Pat. No. 5,778,793 discloses a method of adding a multiple colored logo or gradient shaded logo to the dimpled surface of a golf ball. A method of adding a gradient shaded or multicolored logo to a golf ball is also disclosed, in which a pattern or logo comprising more than one region is formed on a pad printing cliché. Each region comprises many depressions of substantially uniform depth and size. The depressions are also randomized such that there are at least two regions in which the distance between the depressions making up the region varies, creating a gradient shading effect. The number of colors is typically limited to four and each color may only be printed individually, and only opaque inks can be employed to attain the logo colors. If more than 4 colors are desired, correct alignment of the printing machinery, called registration, to add the extra set of colors is difficult. Additionally, use of a screen is required, along with many manufacturing steps, changes in the process if additional colors are to be used, all of which add to the total cost of printing a logo on golf balls.

SUMMARY OF THE INVENTION

The current invention is directed to a method for etching a pad-printing cliché and printing an image therefrom on a golf ball comprising providing a film positive of an image; placing the film positive on a variable-depth pad-printing cliché having a photocurable pre-polymer surface; curing the pre-polymer; removing the film positive from the polymer surface; washing the pad-printing cliché with a flat brush having a plurality of bristles with a diameter of less than about 0.002 inches for a first predetermined time sufficient to remove any uncured pre-polymer, such that the pad-printing cliché has the image etched into the pre-polymer surface, said etched image having a substantially homogeneous bottom surface that is free of truncated cones and defects formed by screening; heating the pre-polymer for a second predetermined time sufficient to fully dry the pre-polymer; further curing the pre-polymer exposed by the washing step; providing a golf ball having a dimpled surface; distributing a layer of ink over the etched image in the pad-printing cliché; providing a pad for transferring the ink from the pad-printing cliché to the dimpled surface; and transferring the image from the surface of the pad-printing cliché to the dimpled surface of the golf ball, wherein the image is free from screening defects.

In one embodiment, the image contains multiple regions where at least one region has an area of less than about 0.001 $in^2$. In another embodiment, the image contains at least one line having a thickness of less than about 0.001 inches. In still another embodiment, the pre-polymer is cured by irradiation with ultraviolet light for a time of less than about 10 min. In a preferred embodiment, the pre-polymer is cured by irradiation with ultraviolet light for a time of about 1 to 2 min.

In another embodiment, the washing step is accomplished by a bristled brush. In a preferred embodiment, the washing step is accomplished by a flat plush brush that is pressured by a weighted platen. Preferably, the flat plush brush comprises a polymeric fiber and has bristles having a diameter of about 0.001 to 0.002 inches and a length of about 0.2 to 0.3 inches. More preferably, the bristles are arranged in a plurality of plugs, each plug containing a plurality of bristles. Preferably, each plug contains about 25 to 75 bristles. In a further embodiment, the first predetermined time is between about 0.1 and 120 s. In a preferred embodiment, the first predetermined time is between about 1 and 5 s.

In still another embodiment, the etched image has a depth of less than about 0.002 inches. Preferably, the etched image has a depth of between about 0.0005 and 0.001 inches. More preferably, the etched image has a depth of between about 0.0007 and 0.0009 inches. In one embodiment, the second predetermined time is less than about 60 min. In a preferred embodiment, the second predetermined time is between about 10 and 20 min.

In yet another embodiment, the pre-polymer is further cured by exposure to ultraviolet light for less than about 30 min. Preferably, the pre-polymer is further cured by exposure to ultraviolet light for about 5 to 10 min.

DEFINITIONS

Figure 1:
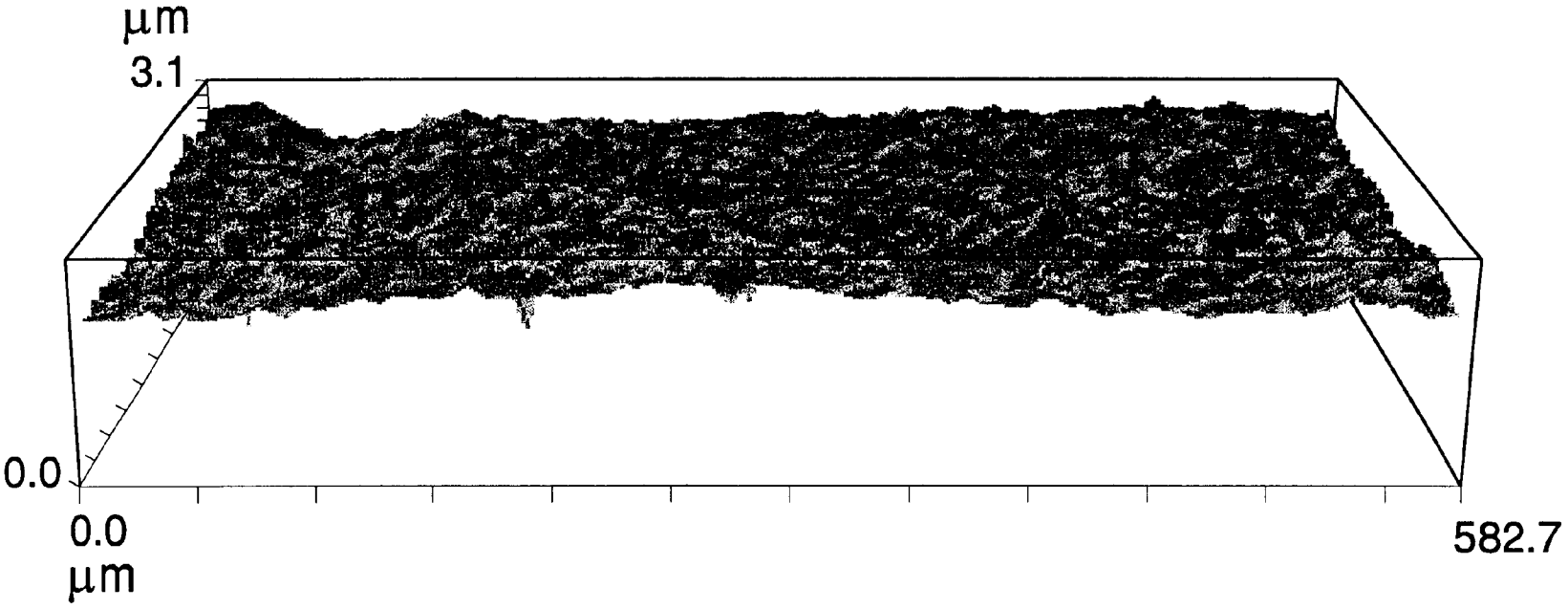
FIG. 1 is an optical profiler spectrum showing the surface roughness of the bottom of an etch washed with standard bristles.

As used herein, the terms "pattern," "image," or "logo" are the same for purposes of this invention and are considered to mean any symbol, letter, group of letters, design, image, etc. that can be added to the dimpled surface of a golf ball.

As used herein, the term "shading" is meant to encompass those circumstances where the intensity of a particular color is gradually reduced by reducing the number of pixels of that color.

As used herein, the term "gradient" refers to the rate of chance in distance between pixels.

The term "about," as used herein in connection with one or more numbers or numerical ranges, should be understood to refer to all such numbers, including all numbers in a range.

DETAILED DESCRIPTION OF THE INVENTION

The present invention is directed to logos or patterns which appear oil golf balls and which incorporate a single spot color or a plurality of different colors and/or a shading effect in all or part of the design. In a preferred embodiment of the present invention, a photopolymer (also known as a prepolymer) plate is etched, without screening, with the image to be placed on a golf ball surface. The etched image may be the entire image if the image is to be a single color, or it may be a specific part of an image that is dedicated to one particular color of a multi-colored image.

The logo or pattern to be printed on the golf ball is scanned into a computer as a graphic image in one of many color image formats, such as "RGB" (3-color system comprising red, green, and blue) and "CMYK" (4-color system comprising cyan, magenta, yellow, and black). The RGB color space is limited to colors that can be defined as 0 to 1000% red, 0 to 100% green, and 0 to 100% blue, whereas the CMYK color space is limited to colors which can be defined as 0 to 100% cyan, 0 to 100% magenta, 0 to 100% yellow, and 0 to 100% black. A six-color system exists that adds the colors orange and green to the CMYK color space, allowing for even greater color range to be obtained. The image is then typically imported into image manipulation software, such as Adobe Photoshop, that enables the design to be separated into the distinct colors of the selected color system (e.g., CMYK), allowing the designers to see, prior to printing, the design and color-channel output. Preferably, the CMYK system is used with the current invention, especially for images that require complex overlapping of colors to form colors different from the four primary colors of the CMYK process.

After conversion and image manipulation, the logo can then be added to a medium which can serve as a positive for addition of the logo to a pad printing cliché or "plate." According to the present invention, creating the plate is accomplished by situating the film positive containing the image of the logo, over a blank plate. Any plate capable of accepting an image and performing, as a pad printing cliche can be used according to the present invention. Preferably, the photopolymer plate is a variable relief photopolymer plate. The photopolymer plate typically comprises foul sections: a base layer, an adhesive layer, a relief layer, and a protective film. Treated carefully, photopolymer plates can produce several thousand impressions. A metal backing plate (the base layer) is coated with a photosensitive polymer (the relief layer) which can polymerize under the action of radiation such as UV light, and becomes hard.

The base layer may be constructed of many materials, such as steel, aluminum, and plastic, but is preferably steel. The thickness of the photopolymer plate is typically from about 0.01 to 0.04 inches. Preferably, the thickness of the photopolymer plate is about 0.02 inches. The adhesive layer is present to join the base layer to the relief layer. The relief layer is the actual photopolymer material in which the etched image is created. The photosensitive layer may be made of any polymer material suitable for curing with radiation. Suitable polymers include polyester, nylon, acrylate class polymers, etc. and are known in the art. The thickness of the relief layer is typically from about 0.001 to 0.03 inches. Preferably, the thickness of the relief layer is about 0.008 inches. Plates having a polymer layer thereon are commercially available. One example of a photopolymer plate is the "WSA-52" Nylograv plate from BASF of Germany.

When the positive of the logo is situated above the plate, ultraviolet ("UV") light is introduced to the surface of the plate that is not covered by the logo. In a preferred mode of the present invention, UV light is supplied by a plate exposure unit such as those available from Jet U.S.A. Corp. of Collingdale, Pa., as Jet Model JE-A3-SS, or a Transtech America, Inc. exposure unit such as model #M10355 or 142202. The plate and logo may be exposed to UV light for any period sufficient to harden the polymer coated surface of the plate which is subjected to the UV light. A preferred exposure period is from about 1 second to about 270 s, or, more preferably, for a period of from about 45 s to about 180 s. The most preferred exposure period is 75 s.

Unlike conventional pad printing methods, though, the variable depth plate of the current invention is not screened after the initial irradiation with UV light. In conventional pad printing with variable relief plates, at this point in the process, a screen film containing 200 to 300 lines per inch is placed on the undeveloped plate prior to irradiation with a second dose of UV light. This screening step, coupled with the stochastic screening routinely added to the image on the film, effectively places "dots over dots," many times causing problems, such as moiré patterns and inconsistent ink transfer from the plate to the pad surface (and subsequently to the golf ball surface) resulting in poor image quality of the logo or indicia. In an effort to solve these aforementioned problems, the current invention is directed to an unscreened image. Eliminating the screening, process of conventional pad printing methods, enables a greater and more homogeneous amount of ink to be present in the etched area of the plate. Eliminating the screening dots also eliminates the problem of moiré patterns in the CMYK images and allows for better and brighter colors (due to more ink being present). Further, eliminating the dots allows lines to have better resolution (i.e., be thinner) and be continuous at this resolution because there are no screened dots to "break up" the lines.

After exposure to UV light, the plate can be washed to remove that polymer on its surface that was not hardened through exposure to UV light (i.e., the polymer material that was blocked from UV irradiation by the image positive on the surface of the plate). The removal of such uncured polymer can be accomplished by any method, such as with water or an alcohol-based solvent. However, it is preferred that the uncured polymer be removed using water. Apparatus for removing uncured polymer are commercially available from Jet U.S.A. Corp. of Collingdale, Pa., Such as Jet Model JW-A3-PD. The brushes employed in these washing units typically contain nylon bristles and can wash out uncured polymer material to a minimum depth of about 0.001 inches. Although one of ordinary skill in the art would teach that a value of 0.001 inches is acceptable, although not wishing to be bound by any particular theory, it is believed that 0.001 inches should be a maximum value and that smaller etch depths are preferred. Excess water can be removed from the plate using compressed air, a sponge roll, or a combination thereof. Preferably, the excess water is removed using compressed air.

Upon drying, the plate or cliché is heated to a temperature sufficient to remove all water from the cliche. The plate can be heated to 50° C. or higher for a period of from about 1 min to about 5 hr in an oven to harden the polymer coating on the cliche. Preferably, the plate is heated for a period of about 5 to about 30 min. Most preferably, the plate is heated for about 15 min.

When heat treatment is completed, the plate undergoes a post-exposure to UV light for a period of from about 1 min to about 5 hr or more. More preferably, the plate is exposed to UV light for a period of from about 1 min to about 1 hr. Most preferably, the plate is exposed to UV light for about 5 min.

Pad printing plates, made according to the aforementioned procedure, can be used in a pad printing machine to print logos onto the dimpled surface of golf ball using machines such as the Teca-Print® TP-100. The TP-100 is also capable of printing two-color logos. The operating speed for one color is 30 pieces per minute and 21 pieces per minute for two-color work. Three and four color logos can be printed on balls using the Teca-Print® four-color machines. These are custom designed machines in which the operator must place balls into ball holding fixtures located on an indexing oval "carousel" conveyor. There are multiple ball holding fixtures located on the oval track. The basic design of the machine is two Teca-Print® TPX-100 two-color machines integrated with a Teca-Print® pneumatic transfer carousel, 14-station, 4.5-inch indexing system. These systems can be run at 19 pieces per minute.

Any type of ink may be used in the printing process of the present invention. There are numerous types of inks available within the printing industry, such as solvent evaporating inks, oxidation curing inks, reactive (catalyst curing or two-component) inks, baking inks, UV curable inks, sublimation inks, and ceramic and glass inks.

Solvent-based inks are predominant in the pad-printing industry as they dry very rapidly though solvent evaporation alone. They are very versatile inks as they are available in both gloss and matte finishes and perform very well with many thermoplastic substrates. Oxidative curing inks have limited uses in pad-printing applications due to their slow drying speed. They do, however, produce very tough, flexible, weather-resistant ink films and are very useful for printing onto metal and glass surfaces.

It is possible to use one-component inks because their long pot life can make them easier to work with and more economical. Some one-component inks are highly resistant to abrasion and solvents. Curing can take place physically or by oxidation.

Two-component inks are also used extensively in pad printing and contain resins capable of polymerization. These inks cure very rapidly, especially when heated and are generally good for printing on substrates such as metals, some plastics, and glass, and have very good chemical and abrasion resistance. The inks, though, do have a restricted shelf life once the polymerization catalyst has been added. With two-component inks, curing typically takes place over about a 5-day period at a temperature of about 20° C., or over about a 10 min period at a temperature of about 100° C.

Ceramic and gas thermoplastic inks are also used in the pad-printing industry. These inks are solid at room temperature and must be heated in the ink reservoir to a temperature greater than about 80° C. Unlike solvent evaporating inks, pad wetting occurs due to the cooling effect the pad has on the heated ink rather than because of the evaporation of solvent. Ink transfer occurs because the outer surface of the ink becomes tacky when exposed to air. The ink transfer is aided by the cooler surface of the substrate to be printed on.

Ultraviolet ink can also be used in the present invention. UV inks are typically cured by means of UV light having wavelengths of from about 180 nm to about 380 nm. The advantages of using a UV ink are that they are fast and cure thoroughly, they are easy to use and are not affected by small changes in ambient conditions, they retain constant viscosity (i.e., they do not dry up quickly), and they use smaller amounts of combustible organic solvent such that little or no solvent fumes escape into the working environment and are, therefore, environmentally safer. Small amounts of solvent may be added to the UV inks for certain applications to enable the ink to transfer in a conventional manner.

The inks may optionally contain additives such as binders, reactive prepolymers, thinners, low-viscosity mono and poly-functional monomers, photoinitiators to stimulate polymerization, stabilizing additives, flow control agents, wetting agents, pigments, extenders, or combinations thereof.

The thickness of the ink film transferred to a golf ball can be any thickness that is sufficient to provide a clear image of the logo. This thickness can be between about 4 and 50 $\mu$m, preferably from about 4 to 20 $\mu$m. The thickness of the ink film can vary with the ink type and color, and is also influenced by the ink's viscosity, the pad material, the depth of etching in the plate and also environmental factors such as temperature, humidity, and so on.

After the printing process is complete, the golf balls are removed to a dry room to finally cure the ink used for the logo. The dry room is maintained at an elevated temperature to aid in drying the logo ink. The dry room is typically kept at 40° C. and the balls are usually kept in the dry room for approximately four hours.

Another embodiment of the current invention is directed to an improved method for washing uncured polymer material from the etched cliché or plate after initial irradiation with UV light. Rather than using a brush with long, rough bristles, it is the object of the current invention to employ a washing unit containing a soft, plush surface brush. The rough bristles, as one skilled in the art knows, cause the bottom of the etched layer to be rough and uneven. This inhomogeneous surface causes inconsistency in ink layer thickness and, therefore, poor ink transfer to the golf ball surface. The softer, more uniform plush bristles provide a significantly more even and homogeneous wash out, leaving a smooth bottom surface of the etch. The difference between the two types of wash steps (bristles v. plush) can clearly be seen in FIGS. 1 and 2, respectively.

Figure 2:
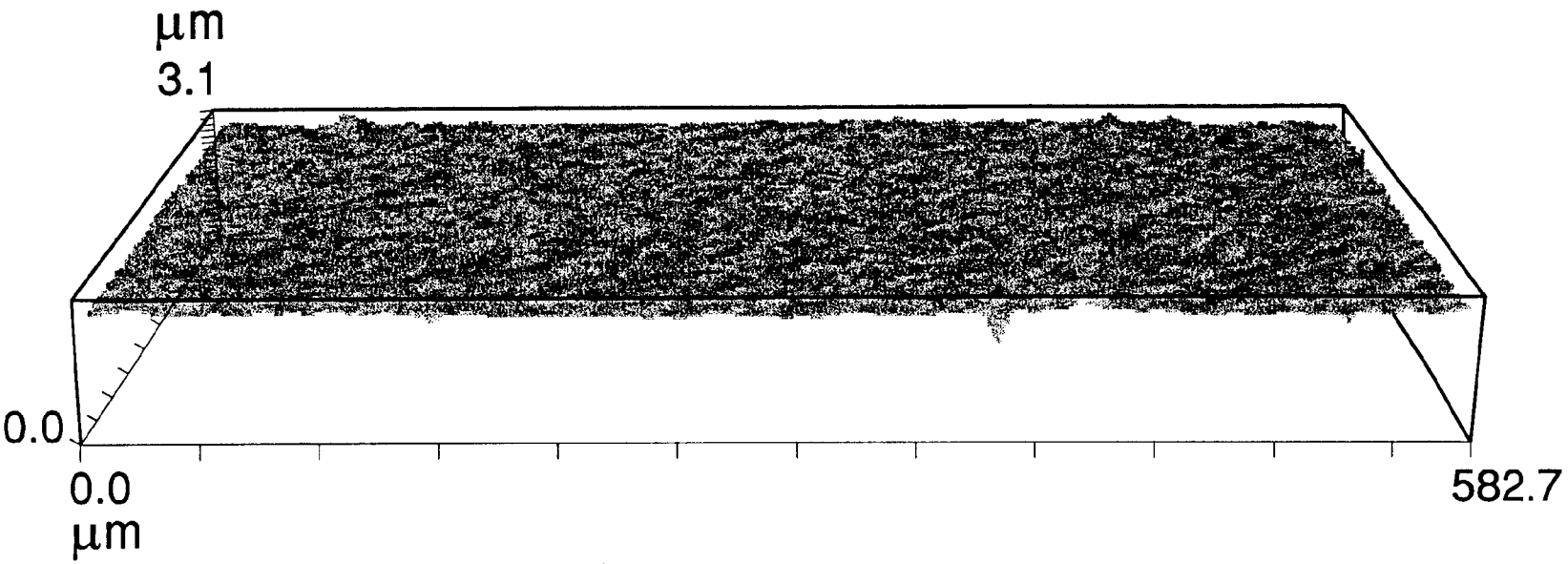
FIG. 2 is an optical profiler spectrum showing the surface roughness of the bottom of an etch washed with the plush material of the present invention.

Referring to FIGS. 1 and 2, the surface roughness of the bottom of an etched area, after washing with a bristled brush (FIG. 1) and a plush brush (FIG. 2), were measured with an optical profiler. Optical profiling is an analytical technique in which light reflected firm the surface of interest interferes with light from an optically flat reference surface causing a fringe pattern to arise. Deviations in the fringe pattern produced by the interference are related to differences in surface height. The interferometer be moved to quantify the deviations, the result of which produce various roughness measurements, such as the average (Ra; the arithmetic average of the deviations from the center plane) and root-mean-square roughness (Rq or RMS; the standard deviation of the height values within a given area). Optical profilers typically have depth resolution of about 0.1 nm and lateral resolution of about 0.35–0.9 $\mu$m. Referring to FIGS. 1 and 2, the Ra roughness of the bottom of the etched plate that was washed with standard bristles was measured and compared to tile Ra roughness of the bottom of the etched plate of the present invention (washed with plush brush). The etched surface washed with a conventional brush is over 74% rougher than the roughness of the etch bottom washed with plush material. This lessening of bottom roughness by the plush material is believed to significantly improve the homogeneity of the ink layer in the etch and, consequently, increase the homogeneous transfer of ink to the pad and subsequently the golf ball.

The plush material has numerous soft, short, bristles having diameters of about 0.001 to 0.002 inches and lengths of about 0.2 to 0.3 inches. The bristles are preferably constructed from a polymeric fiber, such as nylon, and are arranged into plugs, each plug containing a plurality of bristles. Preferably, each plug contains about 25 to 75 bristles. The plugs are preferably attached to a woven surface that is attached to a supporting surface, such as a metal or plastic plate. The plush material contains a plurality of plugs which, when arranged in this manner, allow the material to be very soft yet robust enough to remove uncured polymer from the plates in a much-improved fashion. Preferably the density of plugs is about 150 to 250 plugs/in$^2$.

The plush brush is attached to a platen which is directionally- and time-controlled by a motor connected to the platen. In a preferred mode of the current invention, the washing unit allows for only one-directional platen rotation and has a timer having at least 1-s resolution, such as the modified Mini II® processing unit sold by Napp Systems, Inc. of San Marcos, Calif.

The platen can be made of any material, such as steel, aluminum, or plastic. Preferably, the platen is constructed of steel. In one embodiment of the current invention, the washing efficiency may be adjusted with variable pressure applied to the platen. Weights may be added to the platen to add this pressure, for example. Additionally, other means of adjusting platen pressure, even at various different locations so that the plush material is pushed against the plate surface at varying pressures, would be readily known to those of ordinary skill in the art. The pressure on the platen may be adjusted as a function of wash time, i.e., partial wash at a first pressure followed by a second wash at a second, different pressure.

The plush material of the current invention allows for better control of the depth of etch, as well as providing a more homogeneously-flat bottom surface. Additionally, the plush material is less likely to leave swirl or bristle marks in the polymer surface at the bottom of the etch. The depth variation is especially problematic when the image to be printed has large "open" areas to be filled with ink, i.e., when printing spot colors. Therefore, gaining much finer control over the profile of the bottom of the etched area significantly aids in better controlling the amount of ink that is available at any given area within the etch.

The finer control of the pressure on the platen, combined with the more even wash out, allows for finer control of the etch depth. Preferably, the depth of etch should be less than about 0.001 in. More preferably, the depth of etch should be between about 0.0005 and 0.001 in. Most preferably, the depth of etch should be between about 0.0007 and 0.0009 in.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing, description. Such modifications are also intended to fall within the scope of the appended claims.

What is claimed is:

1. A method for etching a variable depth relief pad-printing cliché and printing an image therefrom on a golf ball comprising the steps of:

providing a film positive of an image;

placing the film positive on the variable-depth pad-printing cliché having a photocurable pre-polymer surface;

curing the pre-polymer;

removing the film positive from the pre-polymer surface;

washing the pad-printing cliché with a flat brush having a plurality of bristles with a diameter of less than about 0.002 inches for a first predetermined time sufficient to remove any uncured pre-polymer, such that the pad-printing cliché has the image etched into the pre-polymer surface, said etched image having a substantially homogeneous bottom surface that is free of truncated cones and defects formed by screening;

heating the pre-polymer for a second predetermined time sufficient to fully dry the pre-polymer;

further curing the pre-polymer exposed by the washing step;

providing the golf ball having a dimpled surface;

distributing a layer of ink over the etched image in the pad-printing cliché;

providing a pad for transferring the ink from the pad-printing cliché to the dimpled surface; and transferring the image from the surface of the pad-printing cliché to the dimpled surface of the golf ball, wherein the image is free from screening defects.

2. The method of claim 1, wherein the image contains multiple regions wherein at least one region has an area of less than about 0.001 in$^2$.

3. The method of claim 1, wherein the image contains at least one line having a thickness of less than about 0.001 in.

4. The method of claim 1, wherein the curing step comprises curing the pre-polymer by irradiation with ultraviolet light for a time of less than about 10 min.

5. The method of claim 4, wherein the curing step time is about 1 to 2 min.

6. The method of claim 1, wherein the flat brush is a flat plush brush that is pressured by a weighted platen.

7. A The method of claim 6, wherein the flat plush brush comprises a polymeric fiber and the a plurality of bristles have a diameter of about 0.001 to 0.002 inches and a length of about 0.2 to 0.3 inches.

8. The method of claim 7, wherein some bristles are tightly arranged to form a plug.

9. The method of claim 8, wherein the flat plush brush contains a plurality of plugs.

10. The method of claim 1, wherein the second predetermined time is less than about 60 min.

11. The method of claim 1, wherein the first predetermined time is between about 0.1 and 120 s.

12. The method of claim 1, wherein the first predetemined time is between about 1 and 5 s.

13. The method of claim 1, wherein the etched image has a depth of less than about 0.002 in.

14. The method of claim 13 wherein the etched image has a depth or between about 0.0005 and 0.001 in.

15. The method of claim 14, wherein the etched image has a depth of between about 0.0007 and 0.0009 in.

16. The method of claim 15, wherein the second predetermined time is between about 10 and 20 min.

17. The method of claim 1, wherein the step of further curing comprises exposure to ultraviolet light for less than about 30 min.

18. The method of claim 1, wherein the step of further curing comprises exposure to ultraviolet light for about 5 to 10 min.

* * * * *